US009303632B2

(12) United States Patent
Yoshino

(10) Patent No.: US 9,303,632 B2
(45) Date of Patent: Apr. 5, 2016

(54) ENERGY RECOVERY CONTROL CIRCUIT AND WORK MACHINE

(75) Inventor: Tetsuya Yoshino, Tokyo (JP)

(73) Assignee: Caterpillar SARL, Geneva (CH)

( * ) Notice: Subject to any disclaimer, the term of this patent is extended or adjusted under 35 U.S.C. 154(b) by 590 days.

(21) Appl. No.: 13/807,495

(22) PCT Filed: Jun. 29, 2011

(86) PCT No.: PCT/JP2011/064920

§ 371 (c)(1),
(2), (4) Date: Dec. 28, 2012

(87) PCT Pub. No.: WO2012/002439

PCT Pub. Date: Jan. 5, 2012

(65) Prior Publication Data

US 2013/0098023 A1 Apr. 25, 2013

(30) Foreign Application Priority Data

Jun. 30, 2010 (JP) ..... 2010-148585

(51) Int. Cl.
*F04B 7/00* (2006.01)
*E02F 9/22* (2006.01)
(Continued)

(52) U.S. Cl.
CPC ..... *F04B 7/00* (2013.01); *E02F 9/2217* (2013.01); *E02F 9/2292* (2013.01); *E02F 9/2296* (2013.01); *F15B 1/024* (2013.01); *F15B 21/14* (2013.01); *F15B 1/033* (2013.01); *F15B 13/0814* (2013.01); *F15B 2211/20546* (2013.01); *F15B 2211/20576* (2013.01); *F15B 2211/212* (2013.01); *F15B 2211/3133* (2013.01); *F15B 2211/7053* (2013.01);
(Continued)

(58) Field of Classification Search
CPC .... F15B 1/024; F15B 21/14; F15B 2211/212; E02F 9/2217
USPC ..... 60/414
See application file for complete search history.

(56) References Cited

U.S. PATENT DOCUMENTS 7,219,592 B2 5/2007 Nielsen et al.
2005/0051025 A1 3/2005 Nielsen et al.
(Continued)

FOREIGN PATENT DOCUMENTS

CN 1641229 7/2005
CN 1993524 7/2007
(Continued)

OTHER PUBLICATIONS

International Search Report, dated Oct. 11, 2011, which issued during the prosecution of International Patent Application No. PCT/JP2011/064920.
(Continued)

*Primary Examiner* — Dwayne J White
*Assistant Examiner* — Matthew Wiblin
(74) *Attorney, Agent, or Firm* — Troutman Sanders LLP

(57) ABSTRACT

An energy recovery control circuit is provided with an energy recovery system for recovering energy of a work equipment. The energy recovery control circuit includes an recovery control valve block in which a plurality of valves that constitute the energy recovery system are incorporated. The recovery control valve block includes a main spool, in which a plurality of control characteristics concerning recovery of energy are consolidated.

5 Claims, 6 Drawing Sheets

(51) Int. Cl.

| | |
|---|---|
| ***F15B 21/14*** | (2006.01) |
| ***F15B 1/02*** | (2006.01) |
| *F15B 1/033* | (2006.01) |
| *F15B 13/08* | (2006.01) |

(52) U.S. Cl.
CPC .. *F15B 2211/7128* (2013.01); *F15B 2211/761* (2013.01); *F15B 2211/88* (2013.01)

(56) References Cited

U.S. PATENT DOCUMENTS

| | | | | |
|---|---|---|---|---|
| 2006/0081299 | A1 | 4/2006 | Koo et al. | |
| 2007/0074509 | A1 | 4/2007 | Zhang et al. | |
| 2008/0104955 | A1 | 5/2008 | Khalil | |
| 2008/0110165 | A1* | 5/2008 | Hamkins et al. | 60/414 |
| 2008/0110166 | A1 | 5/2008 | Stephenson et al. | |
| 2009/0000290 | A1 | 1/2009 | Brinkman | |
| 2010/0000209 | A1 | 1/2010 | Wada et al. | |
| 2011/0197576 | A1* | 8/2011 | Wada et al. | 60/413 |
| 2012/0000557 | A1* | 1/2012 | McBride et al. | 137/565.18 |

FOREIGN PATENT DOCUMENTS

| | | | | |
|---|---|---|---|---|
| CN | 101220823 | | 7/2008 | |
| CN | 101278130 | | 10/2008 | |
| CN | 101438064 | | 5/2009 | |
| DE | 102011008145 | B3 * | 2/2012 | F15B 1/024 |
| JP | S58-138837 | A | 8/1983 | |
| JP | S59-217001 | A | 12/1984 | |
| JP | H04-120324 | | 4/1992 | |
| JP | 05-163745 | A | 6/1993 | |
| JP | 2006-112619 | A | 4/2006 | |
| JP | 2006-322578 | | 11/2006 | |
| JP | 2008-121893 | A | 5/2008 | |
| JP | 2010-101365 | A | 5/2010 | |
| JP | 2010-121726 | A | 6/2010 | |
| WO | WO 2010047008 | A1 * | 4/2010 | E02F 9/2217 |

OTHER PUBLICATIONS

Japanese Office Action, dated Oct. 23, 2013, which issued during the prosecution of Japanese Patent Application No. 2010-148585, which corresponds to the present application.

Chinese Office Action dated May 5, 2014, which issued during prosecution of Chinese Application No. 201180007711.6, which corresponds to the present application.

Supplementary European Search Report dated Apr. 25, 2014, which issued during prosecution of European Application No. 11800901.8, which corresponds to the present application.

* cited by examiner

ENERGY RECOVERY CONTROL CIRCUIT AND WORK MACHINE

CROSS-REFERENCE TO RELATED APPLICATIONS

This is a U.S. national phase application under 35 U.S.C. §371 of International Patent Application No. PCT/JP2011/064920, filed on Jun. 29, 2011, and claims benefit of priority to Japanese Patent Application No. 2010-148585, filed on Jun. 30, 2010. The International Application was published on Jan. 5, 2012 as International Publication No. WO 2012/002439 under PCT Article 21(2). The entire contents of these applications are hereby incorporated herein by reference.

TECHNICAL FIELD

The present invention relates to an energy recovery control circuit provided with an energy recovery system. The present invention further relates to a work machine that is provided with such a control circuit.

BACKGROUND ART

Some hydraulic excavators and other work machines are designed such that potential energy of a work equipment is recovered to be used for hydraulic pressure source or assisting operation of actuators.

Taking the up-and-down operation of the work equipment by boom cylinders as an example, when a boom that has been raised is moved down, the oil at the head side of the boom cylinders is pushed out under a high pressure by the potential energy of the boom. Should the oil of which the pressure has become high be transformed to thermal energy by means of throttling in the hydraulic circuit or returned to the tank without being utilized, it would be wasteful. Therefore, various energy recovery systems have been proposed, including one shown in FIG. 6, and others similar thereto (e. g. see PTL 1 and PTL 2). With the energy recovery system shown in FIG. 6, oil of which the pressure has become high at the head side of a boom cylinder 1 is fed to an accumulator 5 through a solenoid-operated control valve 2, a poppet valve 3, and a check valve 4 so that the pressure is stored in the accumulator 5, and when an actuator, such as a boom cylinder 1, is moved, the oil stored in the accumulator 5 is released through a pilot-operated control valve 6 and a check valve 7 to a discharge line that serves to feed hydraulic oil from a main pump 8 to a main control valve 9, thereby enabling effective use of the potential energy of the boom.

CITATION LIST

Patent Literature

PTL 1: Japanese Laid-open Patent Publication No. 5-163745

PTL 2: Japanese Laid-open Patent Publication No. 2008-121893

SUMMARY OF INVENTION

Technical Problem

A conventional energy recovery system of this type requires a considerable number of components, such as an accumulator 5, directional control valves 2,6 or the like for switching the function of the accumulator 5 between accumulation and release of pressure, and pipes for connecting these valves or the like, to be provided between an actuator (a boom cylinder 1) of the work equipment and the main control valve 9, resulting in an increase in the space needed for installation as well as production costs.

In order to achieve energy saving, in particular, it is necessary to eliminate waste of energy, and it is desirable to equip a work machine with an energy recovery system. However, the space on the machine body for installation of components has been on a decrease due to the necessity of installation of electric modules and other components for introduction of a hybrid system. As it is difficult to provide electric modules and an energy recovery system at the same time, it is not easy to equip a work machine with an energy recovery system.

In order to solve the above problems, an object of the invention is to provide an energy recovery control circuit that requires less space for installation of an energy recovery system and costs thereof. Another object of the invention is to provide a work machine that is equipped with such a control circuit.

Solution to Problem

An aspect of the present invention relates to an energy recovery control circuit provided with an energy recovery system for recovering energy that a work equipment has. The energy recovery control circuit includes an recovery control valve block in which a plurality of valves that constitute the energy recovery system are incorporated. The recovery control valve block includes a main spool, in which a plurality of control characteristics concerning recovery of energy are consolidated.

According to an example of the aspect of the present invention, the work equipment to which the energy recovery control circuit according to the aspect of the present invention is applied has a boom that is vertically movable by a boom cylinder; and the recovery control valve block has functions such that the potential energy the boom has at a raised position is recovered from the boom cylinder and accumulated in an accumulator during boom-down operation and that the fluid accumulated in the accumulator is directly released to the boom cylinder during boom-up operation.

According to another example of the aspect of the present invention, a first boom cylinder and a second boom cylinder arranged in parallel with each other serve as the boom cylinder to which the energy recovery control circuit according to the example of the aspect of the present invention is applied; and the main spool has an inflow rate control characteristic for controlling pressure accumulation inflow rate from the first boom cylinder into the accumulator, an unload control characteristic for controlling unload from the second boom cylinder, a switching control characteristic for controlling switching of the first boom cylinder and the second boom cylinder between communication and separation, and a release rate control characteristic for controlling release flow rate from the accumulator to the first boom cylinder and the second boom cylinder.

According to yet another example of the aspect of the present invention, the main spool of the energy recovery control circuit according to the aspect of the present invention is controlled at a desired stroke by pilot pressure that is a pressure signal that has been transformed, by means of a solenoid-operated proportional valve, from an electric signal output from a controller.

Another aspect of the present invention relates to a work machine including a machine body, a work equipment having a boom that is mounted on the machine body in such a manner as to be vertically movable by two boom cylinders, and an energy recovery control circuit that is provided with an recovery control valve block according to the aspect of the present invention and mounted on either the machine body or the work equipment, wherein the recovery control valve block has such a control characteristic that fluid recovered from one of the boom cylinders is accumulated in the accumulator during boom-down operation and that the fluid in the accumulator is fed to the two boom cylinders during boom-up operation.

Advantageous Effects of Invention

According to the aspect of the present invention, incorporating components of the energy recovery system together in the single recovery control valve block enables a simple piping arrangement without the components of the energy recovery system being scattered over a wide space, and thereby enables reduction of installation space and costs. Furthermore, as a plurality of control characteristics that are necessary for recovery of energy are consolidated in the single main spool, the number of control actuators required for control of those plurality of control characteristics can be reduced.

According to the example of the aspect of the present invention, because of the recovery control valve block, in which a plurality of control characteristics are consolidated in the single main spool, the present invention has functions such that the potential energy the boom has at a raised position is recovered from the boom cylinder and accumulated in the accumulator during boom-down operation and that the fluid accumulated in the accumulator is directly released to the boom cylinder during boom-up operation. Therefore, the present invention enables more effective use of energy of accumulated pressure compared with cases where accumulated fluid is released to a pump discharge line.

According to the another example of the aspect of the present invention, the main spool has an inflow rate control characteristic for controlling pressure accumulation inflow rate from the first boom cylinder into the accumulator, an unload control characteristic for controlling unload from the second boom cylinder, a switching control characteristic for controlling switching of the connecting portion of the first boom cylinder and the second boom cylinder between communication and separation of the two cylinders, and a release rate control characteristic for controlling release flow rate from the accumulator to the first boom cylinder and the second boom cylinder. Therefore, by means of the single main spool, it is possible to perform switching control between accumulation in and release from the accumulator, as well as perform effective control of inflow rate into and release flow rate from the accumulator. With regard to the inflow rate control characteristic, in particular, flow rate of inflow of accumulated pressure fluid from the single first boom cylinder into the accumulator is controlled, and, with regard to the release rate control characteristic, release flow rate from the accumulator to the two boom cylinders, i.e. the first boom cylinder and the second boom cylinder, is controlled.

Therefore, when pressure is accumulated in the accumulator, the potential energy resulting from the dead weight of the work equipment is concentrated in the single first boom cylinder so that the pressure that is two times as great as the holding pressures of the boom cylinders obtained by the two boom cylinders, i.e. the first boom cylinder and the second boom cylinder, is output from the first boom cylinder and accumulated in the accumulator and that large operating pressure for operating the boom is ensured when energy is released from the accumulator.

According to the yet another example of the aspect of the present invention, the main spool is controlled at a desired stroke by pilot pressure that is a pressure signal that has been transformed, by means of a solenoid-operated proportional valve, from an electric signal output from the controller. Therefore, operation characteristics of the main spool can be freely controlled by controlling electric signals from the controller.

According to the another aspect of the present invention, the recovery control valve block has such a control characteristic that fluid recovered from one of the boom cylinders is accumulated in the accumulator during boom-down operation and that the fluid in the accumulator is fed to the two boom cylinders during boom-up operation. Therefore, during boom-down & pressure accumulation operation, the potential energy resulting from the dead weight of the work equipment is concentrated in a single boom cylinder so that the pressure that is two times as great as the holding pressures of the boom cylinders obtained by the two boom cylinders can be accumulated in the accumulator. As a result, when the boom is raised and energy is released, a necessary operating pressure is generated for raising the boom for loading earth and sand or other operation.

DESCRIPTION OF EMBODIMENTS

Next, the present invention is explained in detail hereunder, referring to an embodiment thereof shown in FIGS. 1 to 5.

Figure 5:
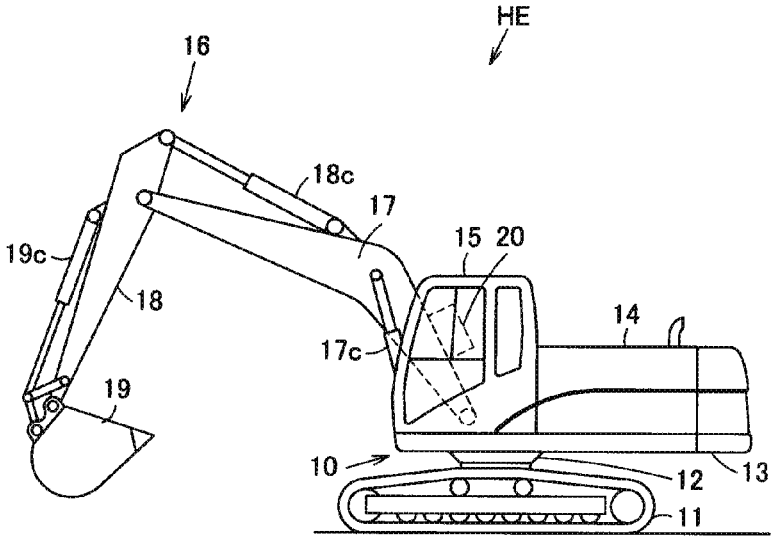
FIG. 5 is a side view of a work machine equipped with the control circuit.

FIG. 5 illustrates a hydraulic excavator HE as a work machine, of which a machine body 10 has a lower structure 11 and an upper structure 13, which is mounted on the lower structure 11 with a rotation bearing unit 12 therebetween and adapted to be rotated by a swing motor. A power system 14, a cab 15, and a front work equipment (hereinafter referred to as the work equipment) 16 for bucket operation are mounted on the upper structure 13 of the machine body 10. The work equipment 16 includes a boom 17, an arm (stick) 18, and a bucket 19. The boom 17 is mounted on the upper structure 13 so as to be capable of vertically pivoting. The arm 18 is pivotally connected to the boom 17 through a shaft, and the bucket 19 is pivotally connected to the arm 18 through a shaft. The boom 17, in other words the work equipment 16, is vertically pivoted by boom cylinders 17*c*. The arm 18 is pivoted by an arm cylinder 18*c*, and the bucket 19 is pivoted by a bucket cylinder 19*c*. The fluid that operates these cylinders is oil, in other words hydraulic oil.

A recovery control valve block 20 is attached to the back face of the boom 17, at a location near the base end of the boom 17, or other appropriate location. The recovery control valve block 20 incorporates a plurality of valves that constitute an energy recovery system for recovering boom energy that is released from the boom cylinders 17*c* when the work equipment 16 is lowered.

Figure 1:
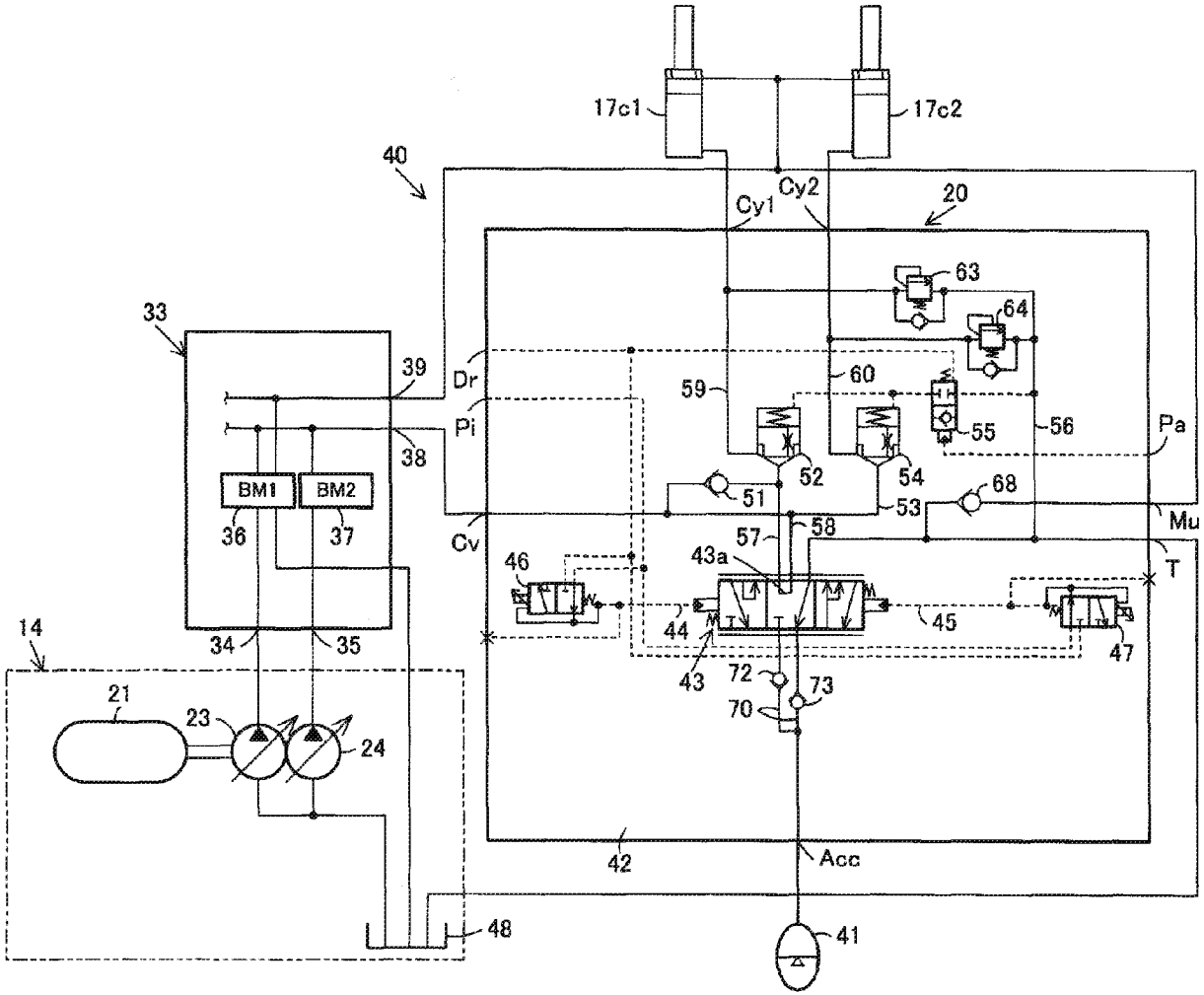
FIG. 1 is a circuit diagram showing an energy recovery control circuit according to an embodiment of the present invention.

FIG. 1 shows the structure of a main hydraulic circuit for controlling the aforementioned power system 14 and two boom cylinders that serve as the aforementioned boom cylinders 17*c*, i.e. a first boom cylinder 17*c*1 and a second boom cylinder 17*c*2. The power system 14 is designed such that an engine 21 drives a first pump 23 and a second pump 24. The first pump 23 and the second pump 24 are pumps with variably controlled capacity.

The main hydraulic circuit for the boom cylinders 17*c* is structured such that discharge openings of the first pump 23 and the second pump 24 are respectively connected to supply ports 34,35 of a main control valve 33. The main control valve 33 includes a first boom spool 36 and a second boom spool 37. Provided between output ports 38,39 of the main control valve 33 and the first and second boom cylinders 17*c*1,17*c*2 is an energy recovery control circuit 40 having an energy recovery system for recovering energy of the work equipment 16.

The control circuit 40 includes the aforementioned recovery control valve block 20 for recovering boom energy. The recovery control valve block 20 is provided between the output port 38 of the first and second boom spools 36,37 in the main control valve 33 and the first and second boom cylinders 17*c*1,17*c*2, which are arranged in parallel so as to serve as the boom cylinders 17*c*.

An accumulator 41 for accumulating energy is connected an accumulator connecting port Acc of the recovery control valve block 20.

The recovery control valve block 20 enables the potential energy the boom 17 has in the raised state to be recovered from the first boom cylinder 17*c*1 and accumulated in the accumulator when the boom 17 is lowered. The recovery control valve block 20 has a block main body 42, in which a plurality of valves that constitute the energy recovery system are incorporated. Serving as the core component of these valves is a main spool 43 of a pilot-operated proportional control type, in which a plurality of control characteristics concerning recovery of energy are consolidated.

The aforementioned main spool 43 of the pilot-operated proportional control type is controlled at a desired stroke by applying pilot pressure to one end or the other end of the main spool 43. This pilot pressure is a pressure signal that has been transformed, by means of solenoid-operated proportional valves, from an electric signal (electric current) output from a controller (not shown). The main spool 43 has various control characteristics, such as an inflow rate control characteristic for controlling pressure accumulation inflow rate from the first boom cylinder 17*c*1 into the accumulator 41, an unload control characteristic for controlling unload from the second boom cylinder 17*c*2, a switching control characteristic for controlling switching of the first boom cylinder 17*c*1 and the second boom cylinder 17*c*2 between communication and separation, and a release rate control characteristic for controlling release flow rate from the accumulator 41 to the first boom cylinder 17*c*1 and the second boom cylinder 17*c*2.

Pilot lines 44,45, which are respectively connected to the two ends of the main spool 43, are respectively connected through solenoid-operated proportional valves 46,47 for adjusting the degree of operation to a pilot pressure port Pi and a drain port Dr. The solenoid-operated proportional valves 46,47 serve to control the degree of operation of the main spool 43. The pilot pressure port Pi and the drain port Dr are respectively connected to a pilot pump (not shown) and a tank 48 so as to provide fluid communication.

Based on signals output from the controller in accordance with the state of pressure accumulation in the accumulator 41 and the degree of operation of the boom lever for operating the boom 17, the solenoid-operated proportional valves 46,47 control the main spool 43 to achieve the optimal stroke, thereby ensuring the maximum recovery of energy and the optimal operation performance.

A control valve port Cv, which is connected to the output port 38 of the main control valve 33, is connected through a bypass check valve 51 to a drift reduction valve 52 of a pilot-operated poppet type and also connected through a line 53 to another drift reduction valve 54 of a pilot-operated poppet type. Pilot pressure chambers at the upper part of the respective drift reduction valves 52,54 are connected to the tank 48 through a tank port T, which is connected through a selector valve 55 to a tank line 56.

By operating the selector valve 55 from an OFF position to an ON position by means of boom-down pilot pressure input from a port Pa, the pilot pressure chambers at the upper part of the respective drift reduction valves 52,54 become linked in fluid communication with the tank line 56, thereby reducing the pressure. As a result, the poppets in the drift reduction valves 52,54 are pushed up by the pressure from the head side of the boom cylinders so that the chambers under the poppets become linked in fluid communication with the chambers at the sides of the poppets.

The aforementioned bypass check valve 51 and line 53, as well as head-side lines 57,58, are connected to the chambers under the poppets of the drift reduction valves 52,54. The head-side lines 57,58 are capable of communicating with the chambers under the poppets of the drift reduction valves 52,54 through a connecting portion 43*a* provided at the main spool 43. The chambers at the sides of the poppets of the drift reduction valves 52,54 communicate with connecting ports Cy1,Cy2 of the respective first and second boom cylinders 17*c*1,17*c*2 through head-side lines 59,60. The head-side lines 59,60 are respectively provided with line relief valves 63,64.

One of the lines provided inside the main spool 43 communicates, through a makeup check valve 68, with a port Mu and also with the tank port T. Through an external pipeline of the recovery control valve block 20, the port Mu communicates with the rod-sides of the first and second boom cylinders 17*c*1,17*c*2.

An accumulator line 70 is provided between the accumulator connecting port Acc and two oil passage lines of the main spool 43. Accumulator check valves 72,73 with checking function for checking reverse flows in directions opposite each other are provided on the accumulator line 70.

As described above, the main spool 43 has a function of a directional control valve for switching the function of the accumulator 41 between accumulation and release of pressure. With this structure, pipes for connecting these valves can be eliminated by incorporating the main spool 43 and a plurality of components, such as various valves, that are necessary for the energy recovery system together in a single recovery control valve block 20, and connecting these various valves by means of lines inside the block main body 42 of the recovery control valve block 20.

Figure 2:
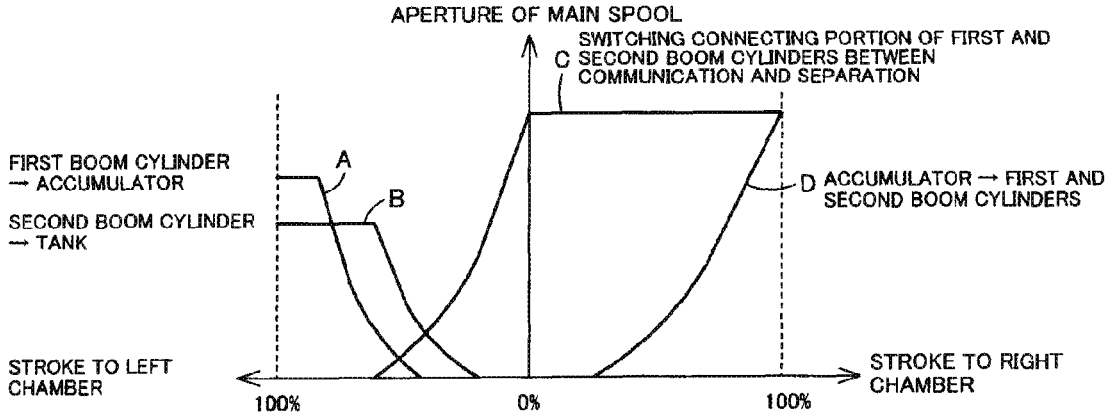
FIG. 2 is a characteristic diagram showing aperture characteristics of a main spool of the aforementioned control circuit.

FIG. 2 shows aperture characteristics that the main spool 43 of the recovery control valve block 20 is required to have for recovering boom energy. To be more specific, the inflow rate control characteristic A for controlling pressure accumulation inflow rate from the first boom cylinder 17*c*1 into the accumulator 41, the unload control characteristic B for controlling unload from the second boom cylinder 17*c*2 to the tank 48, the switching control characteristic C for controlling switching of the connecting portion at which the first boom cylinder 17c1 and the second boom cylinder 17c2 are connected between communication and separation of these two cylinders, and the release rate control characteristic D for controlling release flow rate from the accumulator 41 to the first boom cylinder 17c1 and the second boom cylinder 17c2 are consolidated in the single main spool 43.

Referring to FIG. 2, the switching control characteristic C is transected by an upward arrow. With respect to the upward arrow, the right-side portion of the switching control characteristic C shows that the connecting portion at which the first boom cylinder 17c1 and the second boom cylinder 17c2 are connected is in the fully open state, and the left-side portion of the switching control characteristic C shows that the connecting portion at which the first boom cylinder 17c1 and the second boom cylinder 17c2 are connected is gradually closed in order to prevent a shock.

The solenoid-operated proportional valves 46,47 are connected to the controller (not shown) and controlled based on control signals from the controller.

Next, how the control circuit shown in FIGS. 1 and 2 functions is explained hereunder, referring to FIGS. 1 to 4. The explanation of the function below refers to a case where the boom 17 alone is operated.

(i) When at the Neutral Position (FIG. 1)

The holding pressures at the head sides of the first and second boom cylinders 17c1,17c2 are maintained by the drift reduction valves 52,54 in the recovery control valve block 20.

Through the connecting portion 43a provided at the main spool 43 in the recovery control valve block 20, the head-side line 57 of the first boom cylinder 17c1 and the head-side line 58 of the second boom cylinder 17c2 communicate with each other.

By means of the main spool 43 in the recovery control valve block 20, the line from the head-side line 57 of the first boom cylinder 17c1 to the accumulator connecting port Acc, and the lines from the accumulator connecting port Acc to the head-side lines 57,58 of the first and second boom cylinders 17c1,17c2 are closed, so that the oil line to the accumulator 41 is closed off.

Figure 3:
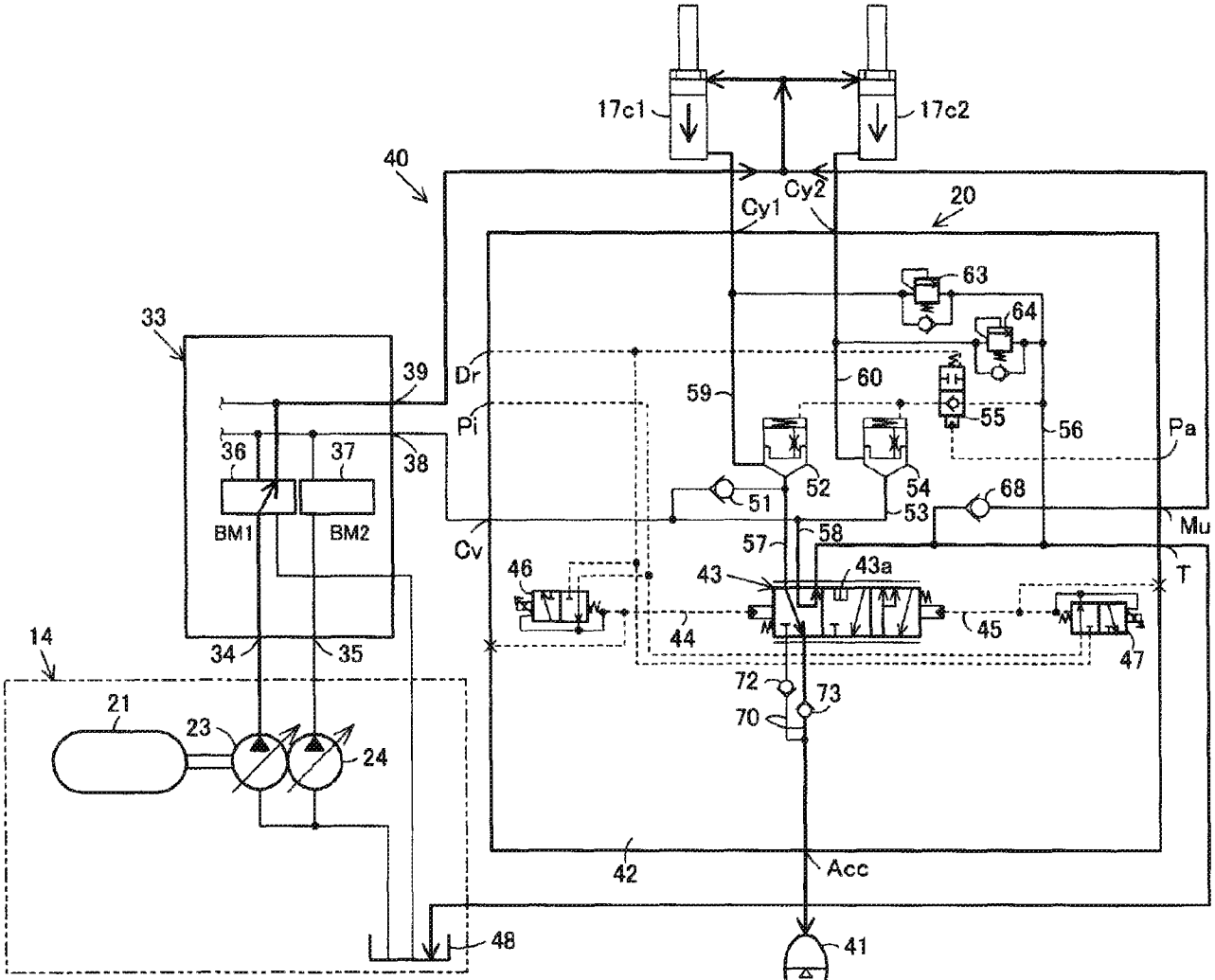
FIG. 3 is a circuit diagram showing the state of the control circuit when the boom is lowered.

(ii) Boom-Down & Pressure Accumulation Operation (FIG. 3)

When the boom operation lever is operated in such a direction as to lower the boom, the drift reduction valves 52,54 in the recovery control valve block 20 are released from operation through the selector valve 55, which has been switched to a pressure release position by boom-down pilot pressure input from the port Pa; the first boom spool 36 in the main control valve 33 is switched in the boom-down direction; and the hydraulic oil discharged from the first pump 23 is fed to the rod sides of the first and second boom cylinders 17c1,17c2.

The main spool 43 in the recovery control valve block 20 moves in the boom-down direction (to the right as viewed in FIG. 3), and, as a result, is switched to the left chamber, thereby gradually closing off the connecting portion 43a so that the oil line from the head-side line 57 of the first boom cylinder 17c1 to the accumulator line 70 is gradually opened. At the same time, the oil lines from the head-side line 58 of the second boom cylinder 17c2 to the tank port T and the port Mu are gradually opened.

The oil at the head side of the first boom cylinder 17c1 passes through various components in the recovery control valve block 20, i.e. the head-side line 59, the drift reduction valve 52, the head-side line 57, lines in the main spool 43, the accumulator check valve 73, and the accumulator connecting port Acc, and then flows to the accumulator 41.

To summarize, because of the dead weight of the work equipment 16 and the pushing pressure of the first pump 23, the oil at the head side of the first boom cylinder 17c1 is accumulated in the accumulator 41.

The oil at the head side of the second boom cylinder 17c2 passes through various components in the recovery control valve block 20, i.e. the head-side line 60, the drift reduction valve 54, the line 53, the head-side line 58, and lines in the main spool 43, and then flows to the tank port T and the port Mu of the recovery control valve block 20.

In other words, a part of the oil that has flowed from the head side of the second boom cylinder 17c2 is returned to the tank 48 as a result of unload control to the tank port T. The rest of the oil that has flowed from the head side of the second boom cylinder 17c2 is recovered from the port Mu and returned to the rod sides of the first and second boom cylinders 17c1,17c2.

As a result of the function described above, the boom 17 descends while the potential energy of the work equipment 16 at the raised position and the discharge pressure energy from the first pump 23 are accumulated in the accumulator 41.

Here, switching the communicating state of the first boom cylinder 17c1 and the second boom cylinder 17c2 to the separated state by gradually closing the connecting portion 43a is done in order to concentrate the potential energy of the work equipment 16 in a single cylinder, i.e. the first boom cylinder 17c1, so that the pressure that is two times as great as the holding pressures of the boom cylinders obtained by the two boom cylinders, i.e. the first boom cylinder 17c1 and the second boom cylinder 17c2, is output from the first boom cylinder 17c1 and accumulated in the accumulator 41 and that a necessary operating pressure is generated when the boom is raised and energy is released for the next operation, such as loading earth and sand.

Figure 4:
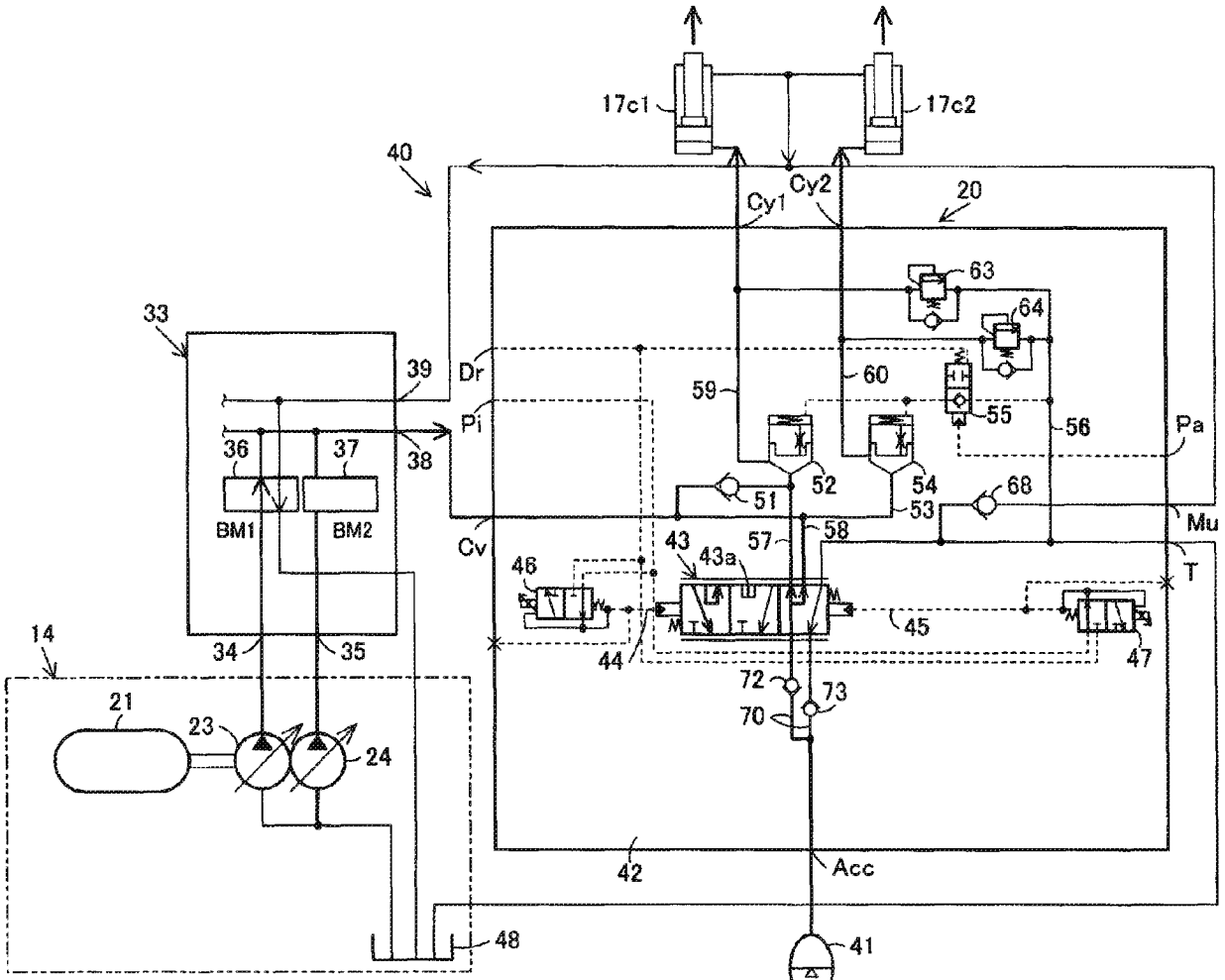
FIG. 4 is a circuit diagram showing the state of the control circuit when the boom is raised.

(iii) Boom-Up & Energy Release Operation (FIG. 4)

The first and second boom spools 36,37 in the main control valve 33 are switched in the boom-up direction so that oil discharged from the first pump 23 and the second pump 24 passes through various components in the recovery control valve block 20, i.e. the bypass check valve 51, the line 53, the drift reduction valves 52,54, and the head-side lines 59,60, and then is fed to the head sides of the first and second boom cylinders 17c1,17c2.

The main spool 43 in the recovery control valve block 20 moves in the boom-up direction (to the left as viewed in FIG. 4), and, as a result, is switched to the right chamber, thereby opening the connecting portion 43a to allow fluid communication so that the oil line that communicates the accumulator connecting port Acc with the head-side lines 57,58 through the accumulator line 70, the accumulator check valve 72, and lines in the main spool 43 is gradually opened.

The oil accumulated in the accumulator 41 flows from the accumulator connecting port Acc and passes through the accumulator line 70, the accumulator check valve 72, lines in the main spool 43, and the head-side lines 57,60 so as to merge with oil discharged from the first pump 23 and the second pump 24. The merged oil passes through the drift reduction valves 52,54 and the head-side lines 59,60 to the head sides of the first and second boom cylinders 17c1,17c2.

As a result of the function described above, energy accumulated in the accumulator 41 during boom-down & pressure accumulation operation as pressure that is two times as great as the holding pressures of the boom cylinders can be used effectively as the driving force to raise the boom 17.

Next, effects of the control circuit shown in FIGS. 1 to 4 are explained.

Incorporating components, such as various valves, that are necessary for the energy recovery system together in the single recovery control valve block 20 enables a simple piping arrangement without the components of the energy recovery system being scattered over a wide space, and consequently enables reduction of installation space and costs.

Furthermore, control of a plurality of valves necessary for recovery of boom energy is consolidated in the single main spool 43, thereby enabling reduction of the number of control actuators, such as solenoid-operated control valves, that are required for control of those plurality of valves.

Furthermore, a plurality of valves are integrated in the recovery control valve block 20 in which a plurality of control characteristics A,B,C,D are concentrated in the single main spool. As a result, the recovery control valve block 20 can be mounted on or incorporated in the main control valve 33, or, as shown in FIG. 5, attached to the back face of the boom 17, at a location near the base end of the boom 17. Furthermore, as it is also possible to provide in a space-efficient manner the recovery control valve block 20 at such other location on the upper structure 13 that facilitates maintenance and management, the invention described above makes maintenance more convenient.

Another benefit of the invention lies in that it is possible to structure an energy recovery system by using a standard system. This can be achieved by adding the recovery control valve block 20 to the standard system in such a manner that control of the system can be switched from normal control to energy recovery control merely by switching the main spool 43 of the recovery control valve block 20. As a result, costs and reliability, as well as fail-safe capability against malfunction or other troubles, can be improved.

Figure 6:
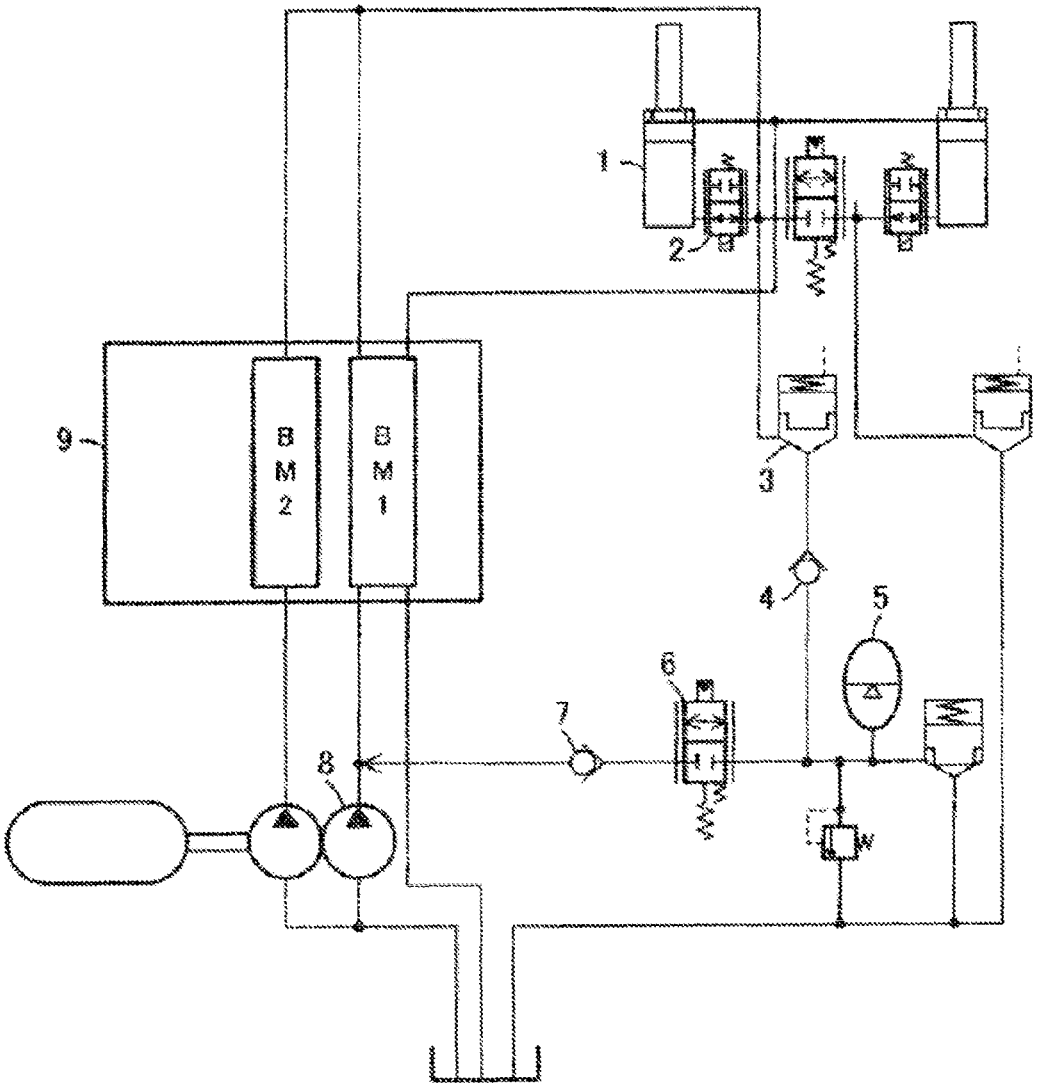
Prior Art FIG. 6
FIG. 6 is a circuit diagram showing a conventional control circuit.

Furthermore, the recovery control valve block 20, in which a plurality of control characteristics A,B,C,D are consolidated in the single main spool, has functions such that the potential energy of the boom 17 at a raised position is recovered from the first boom cylinder 17*c*1 and accumulated in the accumulator 41 as shown in FIG. 3 during boom-down operation and that the oil accumulated in the accumulator 41 is directly released to the first boom cylinder 17*c*1 and the second boom cylinder 17*c*2 as shown in FIG. 4 during boom-up operation. Therefore, the invention described above enables more effective use of energy of accumulated pressure compared with cases where accumulated oil is released to a pump discharge line, such as in an example of a conventional system shown in FIG. 6.

To be more specific, the single main spool 43 has the inflow rate control characteristic A for controlling flow rate of inflow of accumulated pressure oil from the first boom cylinder 17*c*1 into the accumulator 41 based on the direction and stroke of the main spool 43, the unload control characteristic B for controlling unload from the second boom cylinder 17*c*2 based on the direction and stroke of the main spool 43, the switching control characteristic C for controlling switching the connecting portion 43*a* of the first boom cylinder 17*c*1 and the second boom cylinder 17*c*2 between communication and separation of these two cylinders based on the direction and stroke of the main spool 43, and the release rate control characteristic D for controlling release flow rate from the accumulator 41 to the first boom cylinder 17*c*1 and the second boom cylinder 17*c*2 based on the direction and stroke of the main spool 43. Therefore, by means of the single main spool 43, it is possible to perform switching control between accumulation in and release from the accumulator 41, as well as perform effective control of inflow rate into and release flow rate from the accumulator 41.

With regard to the inflow rate control characteristic A of the recovery control valve block 20, in particular, control of flow rate of inflow of accumulated pressure oil from the single first boom cylinder 17*c*1 into the accumulator 41 is performed during boom-down operation. With regard to the release rate control characteristic D, release flow rate from the accumulator 41 to the two boom cylinders, i.e. the first boom cylinder 17*c*1 and the second boom cylinder 17*c*2, is controlled. Therefore, when pressure is accumulated in the accumulator 41 during boom-down operation, the potential energy resulting from the dead weight of the work equipment 16 is concentrated in the single first boom cylinder 17*c*1 so that the pressure that is two times as great as the holding pressures of the boom cylinders obtained by the two boom cylinders, i.e. the first boom cylinder 17*c*1 and the second boom cylinder 17*c*2, is output from the first boom cylinder 17*c*1 and accumulated in the accumulator 41 and that large operating pressure for operating the boom is ensured when energy is released to feed the oil stored in the accumulator 41 to the two boom cylinders for boom-up operation. As a result, a necessary operating pressure is generated when the boom is raised for loading earth and sand or other operation.

As shown in the left-side portion of the switching control characteristic C in FIG. 2, the connecting portion 43*a* for linking the head sides of the first and second boom cylinders 17*c*1,17*c*2 is gradually closed off from the fully open state. This feature of the invention enables modulation of switching connection and separation of the head sides of the two cylinders, thereby preventing a shock resulting from sudden change in boom action, consequently improving operability of the boom.

The main spool 43 is controlled at a desired stroke by pilot pressure that is a pressure signal that has been transformed, by means of solenoid-operated proportional valves 46,47 for adjusting the degree of operation, from an electric signal (electric current) output from the controller (not shown). Therefore, operation characteristics of the main spool 43 can be freely controlled by controlling electric signals from the controller.

For example, the maximum recovery of energy and the optimal operation performance can be ensured by controlling the main spool 43 at the optimal stroke by means of the solenoid-operated proportional valves 46,47 based on signals output from the controller in accordance with the state of pressure accumulation in the accumulator 41 and the degree of operation of the boom lever for operating the boom 17.

The energy recovery control circuit according to the present invention is also applicable to controlling the boom of a crane.

INDUSTRIAL APPLICABILITY

The present invention can be used in any industry that is involved in production, sales, etc. of an energy recovery control circuit for recovering energy that a work equipment has, as well as a work machine, such as a hydraulic excavator and a crane, that is equipped with such a control circuit.

REFERENCE SIGNS LIST

HE hydraulic excavator as a work machine
10 machine body
16 work equipment
17 boom
17*c* boom cylinder
17*c*1 first boom cylinder as a boom cylinder
17*c*2 second boom cylinder as a boom cylinder
20 recovery control valve block
40 energy recovery control circuit
41 accumulator
43 main spool

46,47 solenoid-operated proportional valve
A inflow rate control characteristic
B unload control characteristic
C switching control characteristic
D release rate control characteristic

The invention claimed is:

1. An energy recovery control circuit provided with an energy recovery system for recovering energy that a work equipment has, the energy recovery control circuit comprising:

a recovery control valve block in which a plurality of valves that constitute the energy recovery system are incorporated, wherein:

the recovery control valve block includes a main spool, the main spool being associated with a plurality of control characteristics concerning recovery of energy, the plurality of control characteristics being adjustable based on at least one of a direction and stroke of the main spool, the plurality of control characteristics including an inflow rate control characteristic, an unload control characteristic, a switching control characteristic and a release rate control characteristic.

2. The energy recovery control circuit as claimed in claim 1, wherein:

the work equipment has a boom that is vertically movable by a boom cylinder; and the recovery control valve block functions such that a potential energy the boom has at a raised position is recovered from the boom cylinder and accumulated in an accumulator during boom-down operation and that fluid accumulated in the accumulator is directly released to the boom cylinder during boom-up operation.

3. The energy recovery control circuit as claimed in claim 2, wherein a first boom cylinder and a second boom cylinder arranged in parallel with each other serve as the boom cylinder;

wherein the inflow rate control characteristic controls a pressure accumulation inflow rate from the first boom cylinder into the accumulator;

wherein the unload control characteristic controls a rate of unload from the second boom cylinder;

wherein the switching control characteristic controls a switching rate of communication and separation between the first boom cylinder and the second boom cylinder; and wherein the release rate control characteristic controls a release flow rate from the accumulator to the first boom cylinder and the second boom cylinder.

4. The energy recovery control circuit as claimed in claim 1, wherein:

the main spool is controlled at a desired stroke by pilot pressure that is a pressure signal that has been transformed, by means of a solenoid-operated proportional valve, from an electric signal output from a controller.

5. A work machine comprising:

a machine body;

a work equipment having a boom that is mounted on the machine body in such a manner as to be vertically movable by two boom cylinders; and an energy recovery control circuit that is provided with an energy recovery system for recovering energy which the work equipment has, the energy recovery control circuit including;

a recovery control valve block in which a plurality of valves that constitute the energy recovery system are incorporated, the recovery control valve block including a main spool, the main spool being associated with a plurality of control characteristics concerning recovery of energy, the plurality of control characteristics being adjustable based on at least one of a direction and stroke of the main spool, the plurality of control characteristics including an inflow rate control characteristic, an unload control characteristic, a switching control characteristic and a release rate control characteristic, and the recovery control valve block being mounted on either the machine body or the work equipment, wherein both the recovery control valve block and the plurality of control characteristics control such that fluid recovered from one of the boom cylinders is accumulated in an accumulator during boom-down operation and that the fluid in the accumulator is fed to the two boom cylinders during boom-up operation.

* * * * *